US006892664B2

(12) United States Patent
Stinson

(10) Patent No.: US 6,892,664 B2
(45) Date of Patent: May 17, 2005

(54) BOAT WITH INTEGRATED SHIFTER

(75) Inventor: Alan Stinson, Gallatin, TN (US)

(73) Assignee: Stratos Boats, Inc., Murfreesboro, TN (US)

( * ) Notice: Subject to any disclaimer, the term of this patent is extended or adjusted under 35 U.S.C. 154(b) by 0 days.

(21) Appl. No.: 10/439,822

(22) Filed: May 16, 2003

(65) Prior Publication Data

US 2004/0226499 A1 Nov. 18, 2004

(51) Int. Cl.[7] ..... B63B 35/14
(52) U.S. Cl. ..... 114/255; 114/363
(58) Field of Search ..... 114/255, 343, 114/363, 364; 440/84, 86, 87; 297/452.11, 452.12, 452.14

(56) References Cited

U.S. PATENT DOCUMENTS

| | | | | |
|---|---|---|---|---|
| 2,957,352 A | * | 10/1960 | Pierce | 477/113 |
| 3,861,747 A | * | 1/1975 | Diamond | 297/452.49 |
| 4,821,445 A | * | 4/1989 | Bass | 43/4.5 |
| 4,823,629 A | * | 4/1989 | Ha | 74/335 |
| 4,974,537 A | * | 12/1990 | Martin | 114/255 |
| 4,986,776 A | | 1/1991 | Hensel et al. | |
| 5,062,516 A | * | 11/1991 | Prince | 477/98 |

OTHER PUBLICATIONS

"2003 Producat Catalog," Skeeter Performance Fishing Boats, 43 pages (©2002).
"Gambler Bass Boats website pages," http://web.archive.org/web/20010519043733/http://www.gambler-boats.com/, 9 pages (May 19, 2001).
"Get Where you want to go.," Sea–Doo Sport Boats, 24 pages (2002).
"Ride & Decide," Champion Boats 51 pages (2002).
"Still Building Legends . . . One at a Time.," Ranger Boats, pp. 1–84 (2003).
"Sugar Sand Showroom 2002," http://www.sugarsand.com/tango4/3.html, 2 pages (2002).
"The Choice of the World's Best Anglers," Nitro, 8 pages (2003).

* cited by examiner

*Primary Examiner*—Sherman Basinger
(74) *Attorney, Agent, or Firm*—Merchant & Gould P.C.

(57) ABSTRACT

A boat having a hull, a driver seat, an interior wall, a motor, a shifter and a shifter cover is disclosed herein. The shifter cover is positioned at a location between the driver seat and the interior wall. The shifter cover defines a shifter slot. The shifter is coupled to the motor and includes a shifter member that extends from beneath the shifter cover upwardly through the shifter slot. The shifter member includes a handle positioned above the shifter cover.

19 Claims, 4 Drawing Sheets

BOAT WITH INTEGRATED SHIFTER

TECHNICAL FIELD

The present invention relates generally to boats. More particularly, the present invention relates to shifters for boats.

BACKGROUND

The design of fishing boats has been influenced by the need for increased performance. One measure of performance for a fishing boat is speed. To maximize speed, high-performance fishing boats are equipped with high horsepower outboard motors. The outboard motors are typically shifted between forward, neutral and reverse by shifters mounted to interior walls of the fishing boats. Another measure of performance relates to deck organization. Deck organization is enhanced through the efficient use of space and the ergonomic placement of components.

SUMMARY

One aspect of the present disclosure relates to a boat including a hull, a motor and a driver seat. The boat also includes a shifter at least partially housed within a shifter enclosure located between the driver seat and an interior wall of the boat. The shifter includes a shifter member that extends from within the shifter enclosure upwardly through a shifter slot. The shifter member includes a handle positioned outside the shifter enclosure.

Another aspect of the present disclosure relates to a recessed seat configuration for a fishing boat.

Examples of a variety of inventive aspects in addition to those described above are set forth in the description that follows. It is to be understood that both the forgoing general description and the following detailed description are exemplary and explanatory only and are not restrictive of the broad inventive aspects that underlie the examples disclosed herein.

DETAILED DESCRIPTION

Figure 1:
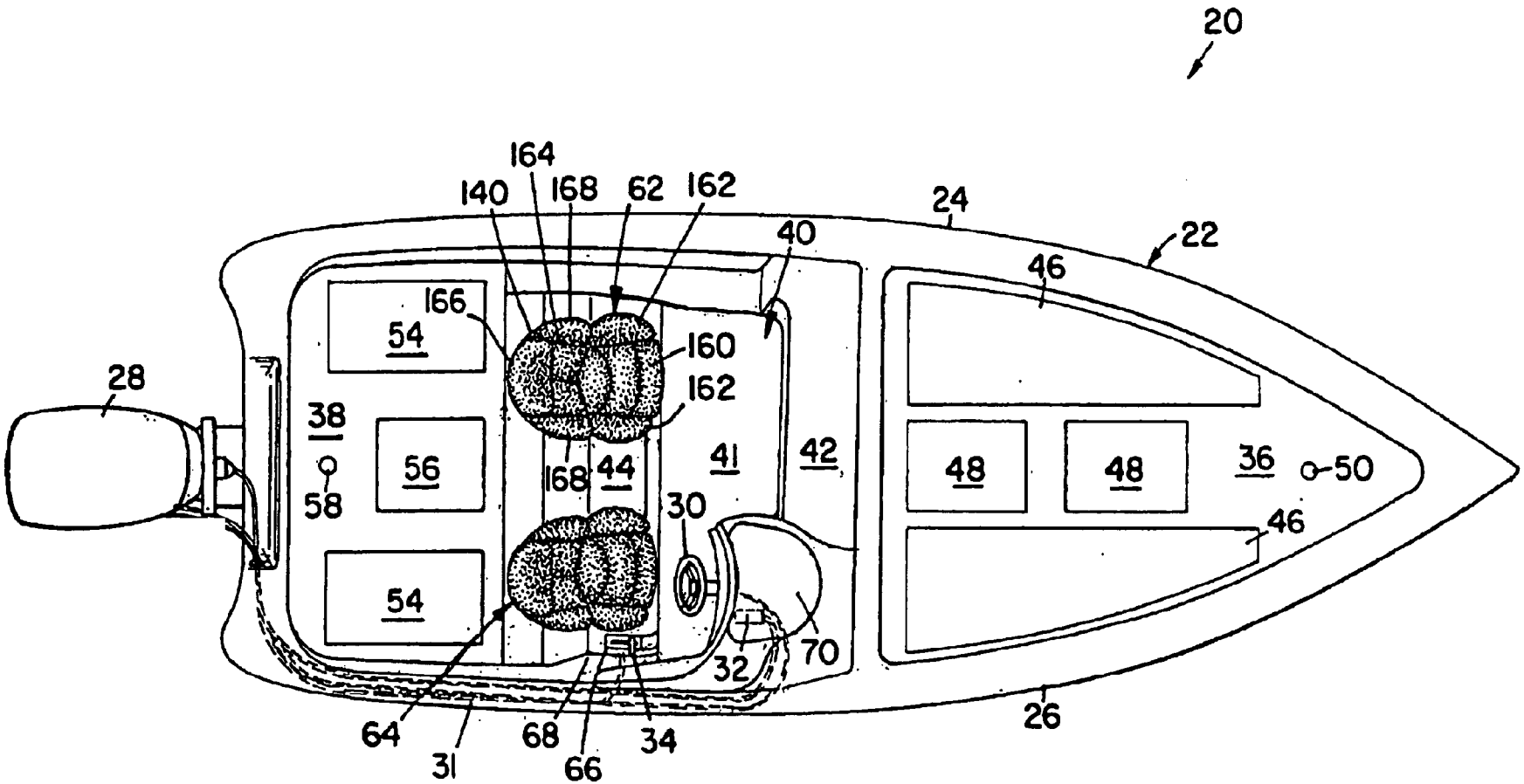
FIG. 1 is a top, plan view of a boat having features that are examples of inventive aspects in accordance with the principles of the present disclosure.

Referring now to FIG. 1, an example boat 20 is shown. The boat 20 is depicted as a bass boat having a hull 22 that includes a port side 24 and a starboard side 26. An outboard motor 28 is mounted to a stern of the hull 22. The boat 20 also includes a steering wheel 30 for turning the motor 28, a foot pedal 32 for controlling the throttle of the motor 28, and a shifter 34 for shifting the motor 28 between forward, neutral and reverse. It will be appreciated that the steering wheel 30, the foot pedal 32 and the shifter 34 are shown coupled to the motor 28 by cables 31 as is conventionally known in the art. However, it will be appreciated that other coupling configurations such as electronic configurations, other mechanical linkages, and hydraulic couplings could also be used.

I. Deck Layout

The deck of the boat 20 includes a front casting platform 36 positioned at the bow of the boat 20, a rear casting platform 38 positioned at the stern of the boat, and a recessed cockpit 40 positioned between the front and rear casting platforms 36, 38. The front and rear casting platforms 36, 38 are elevated relative the recessed cockpit 40. A front step 42 is positioned between the front casting platform 36 and a floor 41 of the recessed cockpit 42. In certain embodiments, the top of the front step 42 is defined by a lid that can be pivoted open to provide access to a cooler. A rear step 44 is positioned between the floor 41 of the recessed cockpit 40 and the rear casting platform 38.

The front casting platform 36 includes two elongated rod boxes 46. Tackle storage compartments 48 are positioned between the rod storage boxes 46. A socket 50 is positioned in front of the tackle storage compartments 48. The socket 50 is adapted to receive the post of a pedestal casting seat (not shown).

The rear casting platform 38 includes port and starboard storage compartments 54. A live well 56 is positioned between the storage compartments 54. A socket 58 is positioned rearward of the live well 56. The socket 58 is adapted for receiving a post of a pedestal casting seat.

It will be appreciated that the rod storage boxes 46, the tackle storage compartments 48, the storage compartments 54 and the live well 56 can all be accessed by pivotable top covers that are flush with the top surfaces of the casting platforms 36, 38 when closed.

Referring still to FIG. 1, a rear seat unit 60 is mounted on the floor 41 of the recessed cockpit 40. The rear seat unit 60 is sized to extend across substantially the entire width of the cockpit 40 and includes a passenger seat 62 and driver seat 64. The rear seat unit 60 defines the rear step 44 at a location between the passenger seat 62 and the driver seat 64. The rear seat unit 60 also includes a shifter enclosure 66 in which the shifter 34 is at least partially housed. The shifter enclosure 66 is positioned between the driver seat 64 and an interior wall 68 of the boat 20 that is positioned adjacent the starboard side 26 of the hull 22.

The boat 20 also includes a driving console 70 positioned in the recessed cockpit 40 at a location in front of the driver seat 64. The driving console 70 includes the steering wheel 30 as well as operational gauges such as a speedometer, fuel gauge, ignition, depth finder, as well as other gauges and instrumentation. The foot pedal 32 is positioned beneath the steering console 70.

II. Integral Shifter

Figure 2:
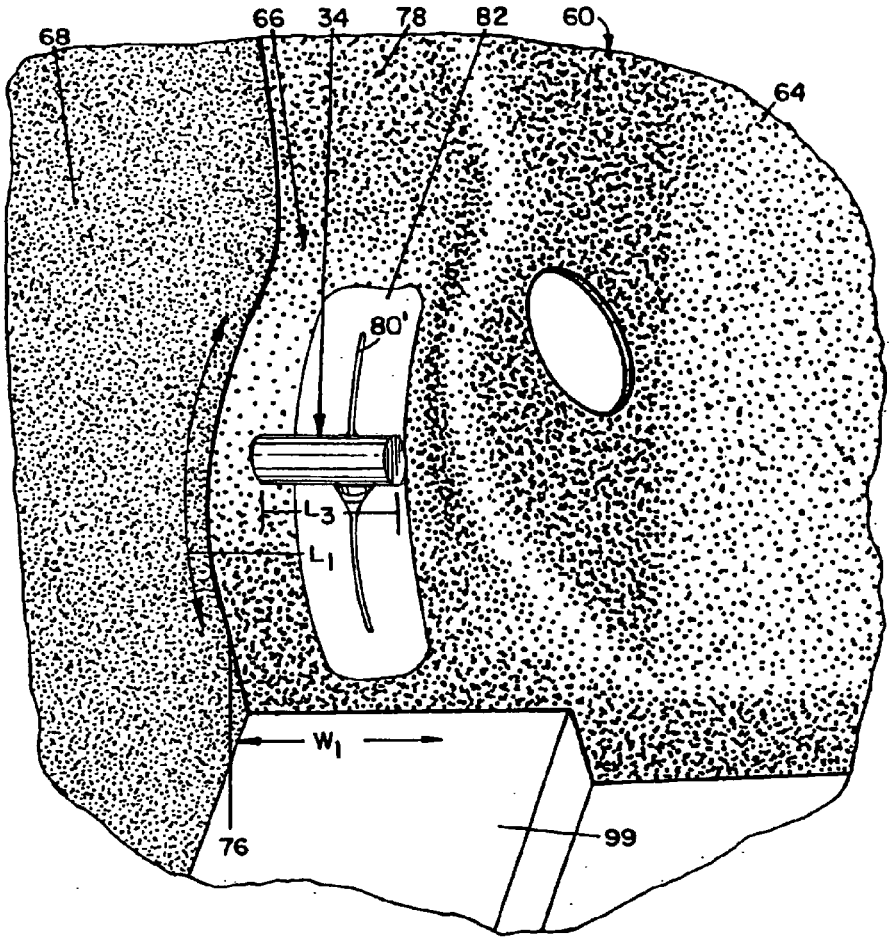
FIG. 2 is a detailed view of a portion of the boat of FIG. 1 showing an integral shifter in accordance with the principles of the present disclosure.

As described above, the shifter 34 is at least partially housed within the shifter enclosure 66. As shown in FIG. 2, the shifter enclosure 66 includes a cover member 76 positioned between the driver seat 64 and the interior wall 68 of the boat. As depicted in FIG. 2, the cover member 76 is integrally connected to the rear seat unit 60. The term "integrally connected" is intended to mean that the cover member 76 is connected to the rear seat unit 60 by a seamless or a unitary connection. In other embodiments, the cover member 76 and enclosure 66 can be separate pieces from the seat unit.

Still referring to FIG. 2, the cover member 76 has a width W that extends completely from the driver seat 64 to the interior wall 68 of the boat 20. The cover member 76 also includes a length L that extends from the floor 41 of the recessed cockpit 40 to the lower end of an upright back portion 78 of the seat unit 60. Preferably, the cover member 76 curves from a generally vertical orientation to a generally horizontal orientation as the cover member 76 extends along the length L. In a preferred embodiment, the curvature along the length of the cover member 76 is defined by a radius having a center at a pivot axis 79 of the shifter 34 (see FIG. 4).

Figure 3:
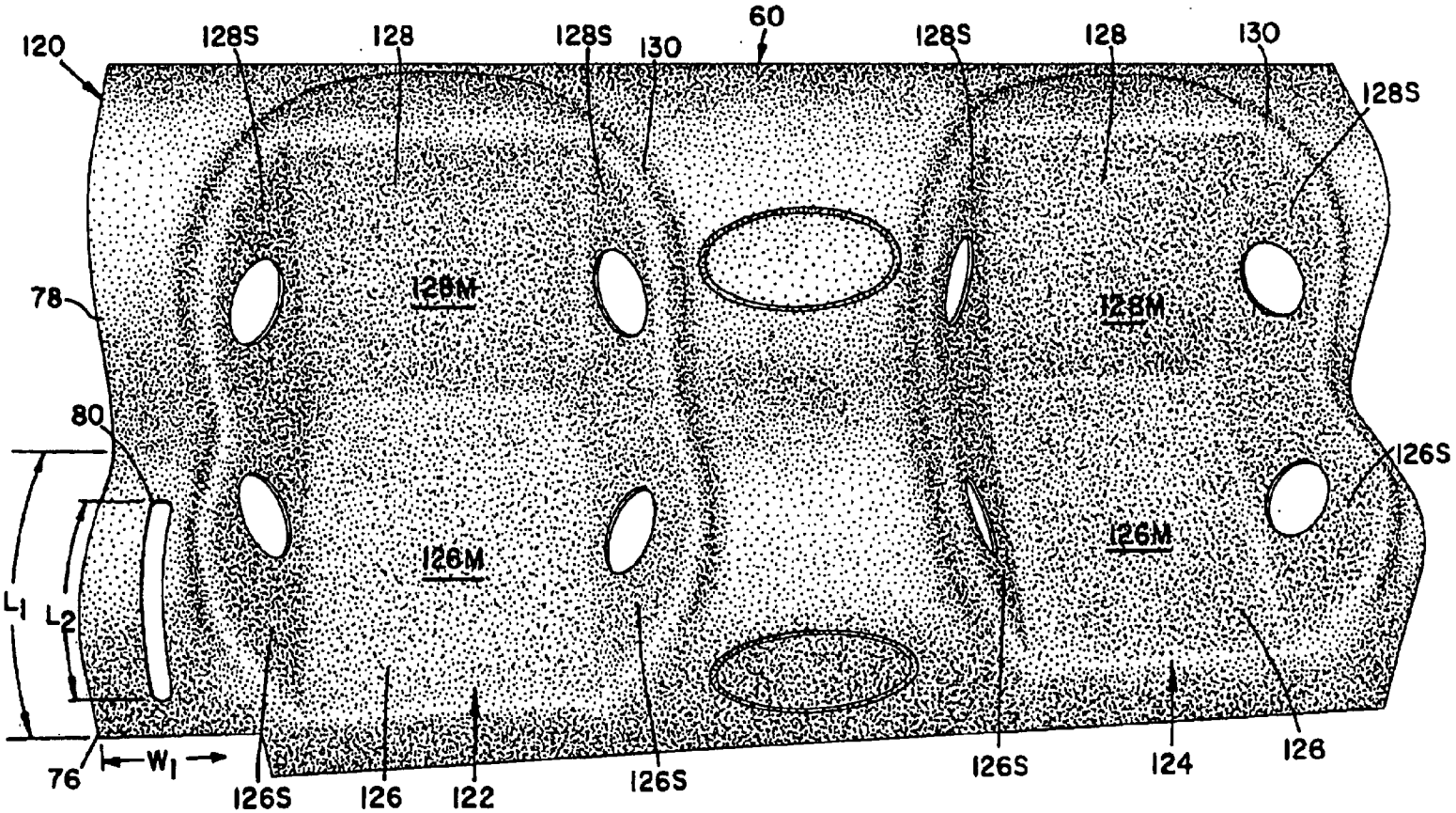
FIG. 3 shows a rear seat unit of the boat of FIG. 1.

Referring to FIGS. 2 and 3, the cover member 76 defines an elongated shifter slot 80 having a length L2 that is generally parallel to the length L1 of the cover member 76. The slot 80 extends along the curvature of the cover member 76 from a generally vertical orientation to a generally horizontal orientation. A gasket 82 (see FIG. 2) is mounted within the slot 80. Preferably, the gasket 82 is made of a resilient material such as rubber or deformable plastic, and defines a slot 80' through which the shifter 34 extends. The gasket 82 is adapted for preventing debris, contaminants or other material from passing through the shifter slot 80 into the shifter enclosure 66. Other gasket configurations such as resilient bristles or other structures could also be used.

Figure 4:
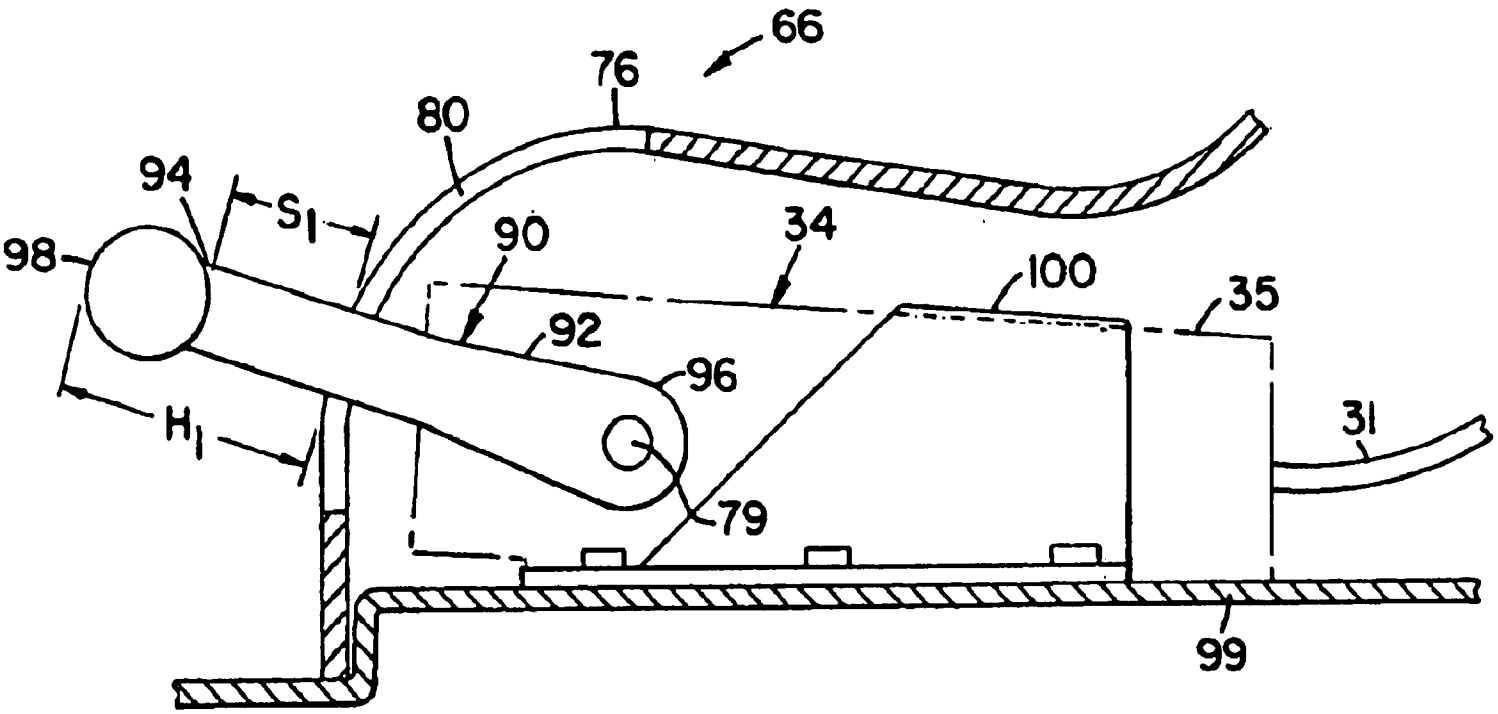
FIG. 4 is a cut-away view taken vertically through the shifter housing of the boat of FIG. 1.

Referring to FIG. 4, the shifter unit 34 includes a conventional shifting arrangement 35 (shown schematically in FIG. 4) that is actuated/driven by a shifter member 90. The shifter member 90 extends from within the shifter enclosure 66 upwardly through the shifter slot 80. The shifter member 90 includes a shaft 92 having an upper end 94 and a lower end 96. The shaft 92 is pivotally movable about the pivot axis 79. The pivot axis 79 is shown passing through the lower end 96 of the shaft 92. A handle 98 is positioned at the upper end 94 of the shaft 92. When the shaft 92 is pivoted about the pivot axis 79, the shaft moves along the length L2 of the shifter slot 80.

The shifter unit 34 is coupled to a boss 99 on the floor 41 of the boat. The shifting arrangement 35 of the shifter unit 34 is mechanically coupled to a corresponding cable 31 that links the shifter unit 34 to the outboard motor 28 in a conventional manner. By moving the shaft 92 along the shifter slot 80, the motor is shifted between forward, neutral and reverse. In certain embodiments, the shifter can play a dual role of shifting the motor and functioning as a throttle for controlling the speed of the outboard motor 28.

Referring to FIG. 2, the handle 98 of the shifter member 90 is arranged at right angles relative to the shaft 92 so as to define a generally T-shaped configuration. The handle 98 has a length L3 that is generally perpendicular to the length L2 (labeled in FIG. 3) of the shifter slot 80. The length L3 extends in a direction between the driver seat 64 and the interior wall 68 of the boat 20. The handle 98 has an offset configuration relative to the shaft 92 such that a majority of the length L3 is located on the starboard side of the shaft 92. Thus, a majority of the length L3 extends from the shaft 92 toward the interior wall 68 and minority of the length L3 extends from the shaft 92 toward the driver seat 64.

While the handle 98 has been depicted as a member that is transverse relative to the shaft 92, it will be appreciated that the term "handle" includes any type of structure that can be manually grasped. For example, the handle could include a shaft without any members that project outwardly therefrom. The handle could also include various types of ergonomic gripping structures provided on the shaft 92 such as knobs, balls, finger grips, pistol grips, or any other structure that can be grasped such as simply a stub of the shaft 92 that projects beyond the shifter slot 80.

Referring to FIG. 4, the handle 98 is preferably positioned such that a spacing S1 exists between the underside of the handle 98 and the outer side of the cover member 76. The spacing S1 is preferably sufficiently great to provide finger clearance between the handle 98 and the cover member 76. In one embodiment, the spacing S1 is less than 3 inches or in the range of 3 to 1 inches. In another embodiment, the spacing S1 is less than 2 inches. In still another embodiment, the spacing S1 is about 1.5 inches. The shifter member 90 also defines a height H1. The height H1 is the distance the shifter member 90 projects beyond the outer surface of the cover member 76. Preferably, the height H1 is relatively small so that a majority of the shifter member 90 is hidden and the shifter member is less likely to be inadvertently bumped, engaged or otherwise contacted. In one embodiment, the height H1 is less than 6 inches. In another embodiment the height H1 is less than 5 inches. In a further embodiment the height H1 is less than 4 inches. In still another embodiment, the height H1 is less than 3.5 inches, or about 3 inches.

Because the curvature of the cover 76 is generally centered about the pivot axis 79 of the shifter member 90, the spacing S1 remains substantially constant as the shifter member 90 is pivoted and moved along the shifter slot 80.

III. Seat Unit

Referring to FIG. 3, a seat support structure 120 of the seat unit 60 is shown in isolation from the boat 20. Preferably, the support structure 120 is a molded part made of a relatively rigid material such as plastic or fiber-reinforced resin. It is preferred for the seat support structure 120 to be sized to extend across substantially the entire width of the recessed cockpit 40 of the boat 20. The shifter enclosure 66 is integrally provided at the starboard side of the support structure 120.

Referring still to FIG. 3, the seat support structure 120 defines a driver side recess 122 and passenger side recess 124. Each of the recesses 122, 124 are defined by a seat rest portion 126 and back rest portion 128. The seat rest portions 126 each include a middle seat rest surface 126M positioned between two side seat rest surfaces 126S that extend upwardly and laterally outwardly from the middle seat rest surface 126M. The back rest portions 128 each include a middle back rest surface 128M positioned between two side back rest surfaces 128S that extend forwardly and laterally outwardly from the middle back rest surface 128M. The seat support structure 120 also includes raised rims 130 that extend about the perimeters of the driver side and passenger side recesses 122, 124. The raised rims 130 outline the driver side and passenger side recesses 122, 124.

In the depicted embodiment, the middle seat rest portions 126M are generally planar, and the side seat rest portions 126S are also generally planar. The side seat rest portions 126S are arranged at oblique angles relative to the middle seat rest portions 126M. Similarly, the middle back rest surfaces 128M and the side back rest surfaces 128S are also generally planar, with the side back rest surfaces 128S being aligned at oblique angles relative to the middle back rest surfaces 128M.

Referring back to FIG. 1, cushions 140 are mounted within the recesses 122, 124. The cushions 140 are preferably secured within the recesses 122, 124 by a removable fastening technique such as Velcro.

The seat rest cushions 140 include middle seat portions 160 supported by the middle seat surfaces 126M, and side seat cushions 162 that flare upwardly and outwardly from the middle seat cushions. The side seat cushions 162 are supported by the side seat rest surfaces 126S. The cushions also include a back cushion 164 and a head rest cushion 166 fastened to the middle back rest surfaces 128M. Side cushions 168 extend forwardly and outwardly from the back cushions 164. The side cushions 168 are supported by the side back rest surfaces 128S.

In one non-limiting embodiment, the middle and side seat cushions 160, 162 are formed as one piece, the back cushion 164 is formed as a second piece, and the side and head rest cushions 168, 166 are formed as a third piece. However, it will be appreciated that any number of different types of cushion configurations could also be used.

With regard to the forgoing description, it is to be understood that changes may be made in detail, especially with respect to the shape, size and arrangement of the parts. It is intended that the specification and depicted aspects be considered illustrative only and not limiting with respect to the broad underlying concepts of the present disclosure.

I claim:

1. A boat comprising:

a hull having port and starboard sides;

a floor positioned within the hull;

a seat unit mounted on the floor, the seat unit defining a passenger side seat recess and a drivers side seat recess, the seat unit also including a shifter enclosure located between the driver side seat recess and the starboard side of the hull, the shifter enclosure defining a shifter slot;

cushions positioned within the driver side seat recess and the passenger side seat recess;

a motor; and a shifter coupled to the motor, the shifter being at least partially housed within the shifter enclosure, the shifter including a shifter member that extends from within the shifter enclosure upwardly through the shifter slot, the shifter member being movable along the shifter slot and including a handle positioned outside the shifter enclosure.

2. The boat of claim 1, further comprising a gasket mounted at the shifter slot.

3. The boat of claim 1, wherein the shifter member projects less than 6 inches beyond the shifter enclosure.

4. The boat of claim 3, wherein the shifter member projects less than 5 inches beyond the shifter enclosure.

5. The boat of claim 4, wherein the shifter member projects less that 4 inches beyond the shifter enclosure.

6. The boat of claim 5, wherein the shifter member projects less than 3.5 inches beyond the shifter enclosure.

7. The boat of claim 1, wherein the seat unit has a support structure having a fiber reinforced resin construction, and the shifter enclosure is a unitary part of the seat unit support structure.

8. The boat of claim 1, wherein the handle of the shifter member includes a shaft that extends through the shifter slot and the handle includes a transverse member positioned at an upper end of the shaft.

9. The boat of claim 8, wherein the transverse member is positioned relative to the shaft such that a majority of a length of the transverse member is located starboard of the shaft.

10. The boat of claim 1, wherein the motor is an outboard motor.

11. The boat of claim 1, wherein the shifter enclosure includes a cover member, and wherein the cover member is curved about a pivot axis of the shifter.

12. The boat of claim 11, wherein the shifter enclosure includes a cover member that extends upwardly from a floor of the boat, the shifter slot extending upwardly along the cover member.

13. The boat of claim 12, wherein the cover member curves from a generally vertical orientation adjacent the floor to a generally horizontal orientation.

14. A fishing boat comprising:

a hull having a bow and a stern;

a front casting deck positioned adjacent the bow;

a rear casting deck positioned adjacent the stern;

a cockpit positioned between the front and rear casting decks;

a livewell and at least one rod storage compartment positioned within the hull;

a seat unit positioned within the cockpit in front of the rear casting deck, the seat unit including a relatively rigid seat support structure that extends across a width of the cockpit, the seat support structure defining a driver side seat recess and a passenger side seat recess, each of the seat recesses including a seat rest portion and a back rest portion, the seat unit defining a shifting slot for a shifter; and cushions positioned within the seat recesses, the cushions including seat cushions recessed within seat rest portions of the seat recesses, and the cushions including back cushions recessed within the back rest portions of the seat recesses.

15. The boat of claim 14, wherein the seat rest portions each include a middle seat rest surface positioned between two side seat rest surfaces that extend upwardly and laterally outwardly from the middle seat rest surface, and wherein the back rest portions each include a middle back rest surface positioned between two side back rest surfaces that extend forwardly and laterally outwardly from the middle back rest surface.

16. The boat of claim 15, wherein the middle seat rest surfaces are substantially planar.

17. The boat of claim 15, wherein the middle back rest surfaces are substantially planar.

18. The boat of claim 15, wherein the middle back rest surfaces and the middle seat rest surfaces are all substantially planar.

19. The boat of claim 15, wherein a raised rim extends along the perimeters of the side seat rest surfaces and the side back rest surfaces.

* * * * *

UNITED STATES PATENT AND TRADEMARK OFFICE

CERTIFICATE OF CORRECTION

PATENT NO. : 6,892,664 B2
DATED : May 17, 2005
INVENTOR(S) : Stinson

It is certified that error appears in the above-identified patent and that said Letters Patent is hereby corrected as shown below:

Title page,
Item [56], References Cited, OTHER PUBLICATIONS, insert:
-- "Triton Boat website pages, "http://web.archive.org/web/*/http://www.tritonboats.com, 37 pages (March 8, 2000). --.

Column 5,
Line 41, "projects less that 4 inches" should read -- projects less than 4 inches --.

Signed and Sealed this

Seventh Day of February, 2006

JON W. DUDAS
*Director of the United States Patent and Trademark Office*